United States Patent [19]

Knott et al.

[11] Patent Number: 4,511,639

[45] Date of Patent: Apr. 16, 1985

[54] METHOD FOR REGENERATING THE CARRIER PARTICLES OF A TWO-COMPONENT DEVELOPER CONSISTING OF CARRIER PARTICLES AND TONER

[75] Inventors: Joseph Knott, Tutzing; Walter Kopp, Taufkirchen, both of Fed. Rep. of Germany

[73] Assignee: Siemens Aktiengesellschaft, Berlin & Munich, Fed. Rep. of Germany

[21] Appl. No.: 365,454

[22] Filed: Apr. 5, 1982

[30] Foreign Application Priority Data

Apr. 15, 1981 [DE] Fed. Rep. of Germany ..... 3115294

[51] Int. Cl.[3] ..... G03G 9/10

[52] U.S. Cl. ..... 430/108; 430/137; 118/652; 118/612

[58] Field of Search ..... 134/1; 118/652, 612; 430/125, 137, 108

[56] References Cited

U.S. PATENT DOCUMENTS 3,801,196 4/1974 Knapp et al. .
3,918,968 11/1975 Kukla et al. ..... 430/108
4,007,982 2/1977 Stange ..... 430/125
4,111,546 9/1978 Maret ..... 134/1

FOREIGN PATENT DOCUMENTS 35000 1/1965 German Democratic Rep. ..... 430/122

*Primary Examiner*—John E. Kittle
*Assistant Examiner*—John L. Goodrow
*Attorney, Agent, or Firm*—Hill, Van Santen, Steadman & Simpson

[57] ABSTRACT

Developer mix is regenerated in a manner which removes toner crust from carrier particles in order to extend the useful time of a developer mix within a developer station of an electrophotographic printing or copying machine. A portion of developer mix is continuously or periodically removed from the main body of developer mix in the developer station and supplied to a regenerator device where the developer particles are exposed to impacts flaking off the toner crust formations. The regenerated developer mix is then recycled back to the main body of mix at the developer station. This regeneration and recycling of developer mix serves to hold substantially constant the efficacy of the developer mixture.

2 Claims, 2 Drawing Figures

METHOD FOR REGENERATING THE CARRIER PARTICLES OF A TWO-COMPONENT DEVELOPER CONSISTING OF CARRIER PARTICLES AND TONER

BACKGROUND OF THE INVENTION

The invention relates generally to a method for controlling the quality of a magnetizable developer mix for use in an electrophotographic printing machine developer and, more particularly, concerns a method for regenerating the carrier particles of a developer mix such that regenerated carrier particles are stripped of toner component crust during recycling.

According to electrophotographic or electrographic principles typically utilized in non-mechanical copying or printing machines, electrostatic latent images of characters to be printed are generated on a recording medium, such as a photoconductive drum or specially treated paper. These electrostatic images are subsequently inked with a print powder, called toner particles and which is typically black, in a developer station. The developer station typically includes at least one developer unit generally referred to in the art as a magnetic brush developer. A magnetic brush developer, as a rule, utilizes a two-component magnetizable developer mix for developing the latent charge images recorded on the recording medium. The two components of the developer mix consist of ferro-magnetic carrier particles and toner particles which contain synthetic components. The carrier particles are covered with a very thin, adhering synthetic or oxide layer, which, in the tribo-electric voltage series, lies far apart from the synethic component of the toner so as to produce mutual forces of attraction. A magnetic brush arrangement serves to conduct developer mix particles past the charge images formed on the recording medium, whereupon the toner adheres to the charge images as a result of electrostatic forces.

The concentration of toner particles within the developer mix, i.e., the percentage of toner particles relative to carrier, relates directly to the characteristics of the developed images. For example, the density of the image will be affected by the toner particle concentration. Undesirable decrease in toner concentration in the developer is prevented by means for periodically adding new toner particles to the developer mix. One system adapted for regulating toner powder concentration within a particulate mixture utilized in a developer is disclosed, for example, in U.S. Pat. No. 3,801,196. There, toner powder concentration is measured as a function of the intensity of light rays transmitted by a reflector means having toner powder adhering thereto.

Due to the constant intermingling of carrier and toner particles in a developer mix, a layer of synthetic material, which is a component of the toner, becomes deposited on the synthetic or oxide layer of the carrier particles. This synthetic material causes a crust to form on the carrier particles, the thickness of which becomes greater and greater with time such that the tribo-electrical forces between the carrier and toner particles are gradually reduced. This reduction of the tribo-electrical forces may eventually render the developer mix unuseable, requiring complete replacement of the mix. In the case of fast copiers or printers, this crusting process necessitates that developer mix be replaced often and in very short time intervals in order to maintain suitable printing or copying quality. The frequent replacement of the developer mix causes frequent and long down times of the printer or copier. Furthermore, as the crusting process occurs, printing quality becomes reduced in direct correlation with the increasing age of the developer mix. In addition, since conventional monitoring devices for measuring toner concentration in the developer mix do not discount or make allowance for the crust component of the carrier particles, inaccurate toner concentration measurements result and frequently indicate toner concentration actually increasing with the age of the developer mix. For example, the crust component in old developer mix can amount to 60–80 percent of the measured toner concentration.

An object of the present invention is to eliminate the need for frequent replacement of developer mix in a developer unit and, at the same time, substantially maintain the printing or copying quality of character images being developed.

SUMMARY OF THE INVENTION

Deterioration of the efficacy of developer mix particles, especially that caused by the crusting of carrier particles with synthetic components coming from the toner particles, is avoided by an inventive method in which developer mix is continuously regenerated through a device which flakes off the toner crust formed on the carrier particles. In accordance with this method, small amounts of developer mix are removed from the developer station and supplied to the regeneration device which vibrates the developer particles into engagement with each other and against wall surfaces to effect flaking of the toner crust. Then, the developer mix particles are returned to the developer station for recycling into the main body of developer mix. Consequently, there results a longer aging characteristic for the developer mix being used in the developer unit. The flaked-off toner crust components remain in the developer mix substantially as fine-ground toner particles which are useable in the development process.

DESCRIPTION OF THE PREFERRED EMBODIMENT

Figure 1:
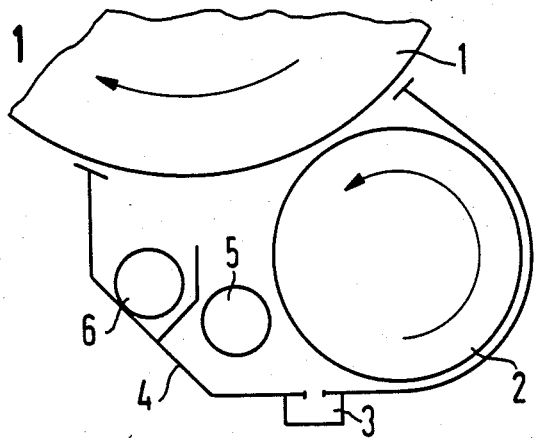
FIG. 1 is a fragmentary schematic side elevational view of a magnetic brush developer unit incorporating the present invention.

FIG. 1 schematically illustrates a magnetic brush developer unit 4 of a type known in the art for use in an electrophotographic printing or copying machine adapted with the present invention. A drum 1 having an annular photoconductive surface is mounted for rotation within the machine frame (not shown). Not shown, but positioned about the drum 1, are conventional character generator stations for making electrostatic latent charge images on the photoconductive drum surface of the characters to be copied or printed. The drum subsequently conducts the charge images through the developer station 4 where the charge images are inked. After the photoconductive drum surface is passed through the developer station, the inked charge images are transferred to a paper web in a known manner at a transfer station.

The developer unit 4, in accordance with magnetic brush developer principles, contains a magnetizable two-component developer mix consisting of carrier granules and toner particles. A magnetic brush or drum 2 is rotatably mounted in the developer unit for continually bringing developer mix into contact with the electrostatic latent images recorded on the photoconductive drum surface. At the photoconductive drum surface, a portion of the toner particles carried by the rotatable drum 2 is transferred to the charged images and the remainder is dropped back onto the main body of developer mix contained in the developer unit. A mixing drum 5 is mounted for rotation within the developer unit in contact with the developer mix particles for continuous mixing of the mix body. The developer mix is replenished with fresh toner particles by means of a dispensing roll 6 mounted in a compartment containing a supply of toner for adding toner particles to the main of developer mix.

During the course of operation of the developer unit, the efficacy of the developer mix reduces with age, primarily as the result of crusting formed on the carrier particles by synthetic components of the toner. In accordance with the invention, the aging process of the developer mix is significantly slowed by means of a regenerator device 3 disposed in communication with the main body of developer mix at, for example, the floor of the developer unit 4. By virtue of a communication opening between the developer unit and the regenerator device, a portion of the developer mix falls into the regenerator 3, where crusting is flaked off the carrier particles and the regenerated developer mix is subsequently returned in recycling fashion to the developer unit 4. By virtue of this recycling process, regenerated developer mix may be supplied to the main body of developer in the developer station, eliminating the need for frequent replacement of developer mix. As a result, a new longer aging characteristic occurs for developer mix.

Figure 2:
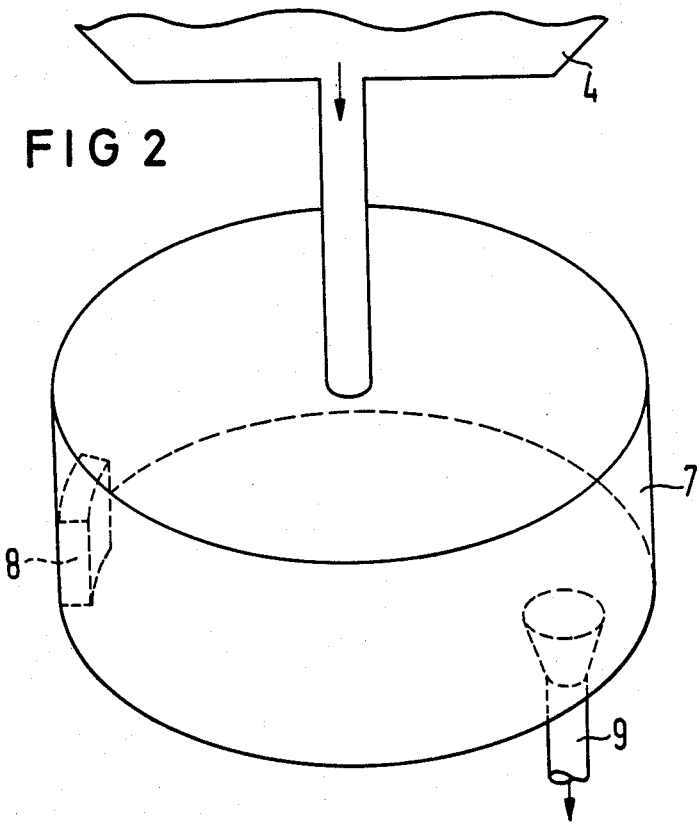
FIG. 2 is a fragmentary schematic perspective view of a developer mix regenerator device in accordance with the present invention.

In accordance with the preferred embodiment of the present invention, a process by which developer mix particles are impacted is used to flake the toner crust portions off of the carrier particles. FIG. 2 illustrates a regenerator device 3 which brings about this impacting. Developer mix is supplied from the developer station by gravity fall through a passageway leading to a substantially cylindrical chamber 7. Supply of developer mix to the chamber 7 may be carried out continuously or periodically at specific intervals by use of suitably controlled valve means. An ultrasonic transmitter means 8 is mounted within the chamber 7 for producing ultrasonic waves which vibrate the developer mix contained in the chamber 7. These ultrasonic waves effect the developer particles such that the carrier and toner particles impact against themselves and one another and also impact against the sidewalls of the chamber. These impacts effect a flaking-off the toner crust on the carrier particles. Subsequently, developer mix is removed from the chamber 7 through a suction line 9 which conducts the regenerated mix back to the main body of developer contained within the developer unit 4. Suitable compressed air conveying means, such as a jet pump device, may be used in connection with the line 9 to transfer the regenerated developer mix back to the developer unit 4.

Although various minor modifications may be suggested by those versed in the art, it should be understood that we wish to embody within the scope of the patent warranted hereon all such modifications as reasonably and properly come within the scope of our contribution to the art.

We claim as our invention:

1. A method for regenerating a developer particulate mix comprising carrier and toner particles contained in a developer unit arranged to deposit toner particles on an image bearing member comprising:

conducting a portion of a main body of said mix in said developer unit to a regenerator device, removing toner crust formations from carrier particles in said regenerator device by impacting with an ultrasonic wave transmitter said mix portion carrier and toner particles with each other and walls of said regenerator device, and returning said mix portion from said regenerator device to said main body in said developer unit.

2. The method of claim 1, wherein said mix portion is continuously removed by gravity fall from said developer unit.

* * * * *